United States Patent [19]

Nakamura

[11] Patent Number: 5,064,293

[45] Date of Patent: Nov. 12, 1991

[54] ROTARY KNEADING SCREW

[76] Inventor: Kensaku Nakamura, 272-1, Bessho-cho, Matsubara-shi, Osaka, Japan

[21] Appl. No.: 636,073

[22] Filed: Dec. 28, 1990

[51] Int. Cl.[5] ..... B01F 7/08

[52] U.S. Cl. ..... 366/324; 366/90; 366/328

[58] Field of Search ..... 366/79, 90, 324, 328, 366/80, 81, 82, 319, 88

[56] References Cited

U.S. PATENT DOCUMENTS

| | | | |
|---|---|---|---|
| 3,986,709 | 10/1976 | Vermeulen | 366/90 |
| 4,107,788 | 8/1978 | Anders | 366/90 X |
| 4,779,989 | 10/1988 | Barr | 366/324 X |
| 4,846,659 | 7/1989 | Nakamura | 366/324 X |
| 4,925,313 | 5/1990 | Nunn | 366/324 X |
| 4,994,223 | 2/1991 | Hestehave et al. | 366/90 X |

FOREIGN PATENT DOCUMENTS

| | | | |
|---|---|---|---|
| 58-89342 | 5/1983 | Japan | 366/90 |
| 61-141512 | 6/1986 | Japan | 366/90 |

*Primary Examiner*—Frankie L. Stinson
*Attorney, Agent, or Firm*—Moonray Kojima

[57] ABSTRACT

This invention relates to a rotary kneading screw installed in an extruder for kneading a synthetic resin such as polyester or vinyl chloride with a material such as calcium carbonate, talc, glass fiber or carbon fiber. The rotary kneading screw comprises a plurality of kneading recesses formed along a helical direction, and resin flow passages formed at a helical pitch greater than that of the kneading recesses. These flow passages may cut in a single machining operation to achieve both a reduced operating time and reduced manufacturing cost.

2 Claims, 3 Drawing Sheets

ROTARY KNEADING SCREW

SUMMARY OF THE INVENTION

This invention relates to a rotary kneading screw installed in an extruder for kneading a synthetic resin such as polyester or vinyl chloride with a material such as calcium carbonate, talc, glass fiber or carbon fiber. The rotary kneading screw comprises a plurality of kneading recesses formed along a helical direction, and resin flow passages formed at a helical pitch greater than that of the kneading recesses. These flow passages may cut in a single machining operation to achieve both a reduced operating time and reduced manufacturing cost.

BACKGROUND OF THE INVENTION

A rotary kneading screw for use in an extruder is disclosed in Applicant's prior U.S. application Ser. No. 279,823. This prior rotary kneading screw comprises a plurality of kneading recesses formed along a helical direction peripherally of a kneading section defining a maximum outside diameter of the screw. Adjacent kneading recesses transversely of the helical direction are connected to one another through flow passages formed.

With the above rotary kneading screw, however, each flow passage must be cut manually adjacent each kneading recess after the plurality of kneading recesses are formed peripherally of the screw. To realize an effective kneading action according to the type and characteristics of material mixture, a cutting technique with a high degree of precision is required which results in a passage cutting operation taking time and trouble. There is also the problem of high manufacturing cost of one rotary kneading screw.

OBJECTS OF THE INVENTION

A primary object of this invention is to provide a rotary kneading screw which may be manufactured in a reduced operating time and at a reduced cost. This object is achieved by a unique construction in which flow passages are formed at a helical pitch greater than that of numerous kneading recesses. These flow passages may cut in a machining operation under automatic control.

Another object of this invention is to provide a kneading recesses which is capable of uniform kneading without reducing the property and molecular weight of the material mixture. This is achieved by applying complex variations in the flow rate, direction and pressure to the material mixture.

Other objects of this invention will be apparent from the following description of the preferred embodiment.

BRIEF DESCRIPTION OF THE DRAWINGS

The drawings show an embodiment of this invention, in which.

DESCRIPTION OF THE PREFERRED EMBODIMENT

An embodiment of this invention will be described in detail hereinafter with reference to the drawings.

The drawings show a rotary kneading screw for use in an extruder. Referring to FIGS. 1 through 8, this rotary kneading screw 1 comprises a kneading section 2 disposed in a longitudinally intermediate portion thereof and forming a maximum outside diameter of the screw. The kneading section 2 defines, peripherally thereof, a plurality of kneading recesses 2*a* extending at a constant helical pitch along a helical direction. The kneading recesses 2*a* become progressively shallower from a material introductive end to a terminal end. However, the kneading recesses 2*a* may have a constant depth throughout the kneading section 2.

As shown in FIGS. 2 through 7, the kneading recesses 2*a* are cut, leaving an elliptical section formed around two eccentric points of the shaft of the rotary kneading screw 1 and extending in the helical direction and toward peripheral surfaces of the kneading section 2.

That is, each of the kneading recesses 2*a* is deepest and broadest at a middle position thereof, and becomes progressively shallower and narrower as it extends in the helical direction away from the middle position. Further, communicating passages 2*b* are cut between adjacent kneading recesses 2*a* in the helical direction for allowing a material mixture to flow in the helical direction.

The above communicating passages 2*b* have a specific construction as set forth hereunder.

Figure 1:
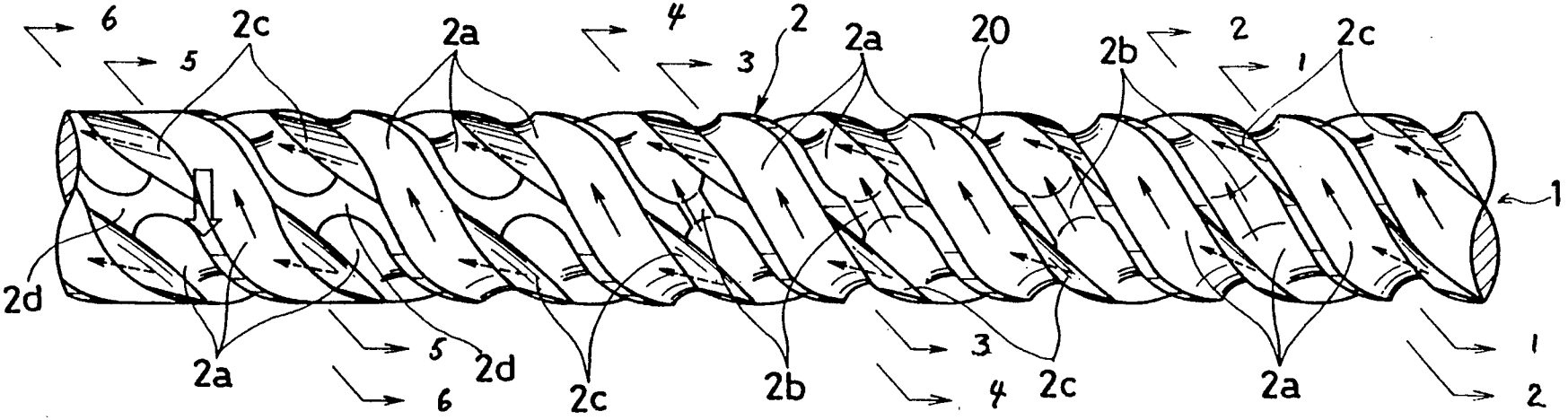
FIG. 1 is an enlarged side view of a kneading section of a rotary kneading screw.
Figure 4:
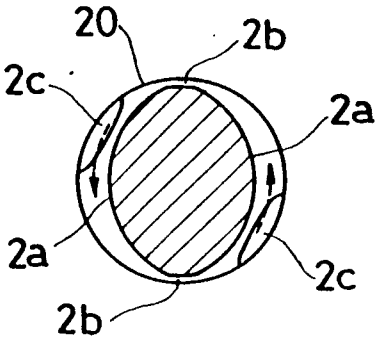
FIG. 4 is a section taken on line 3—3 of FIG. 1.
Figure 2:
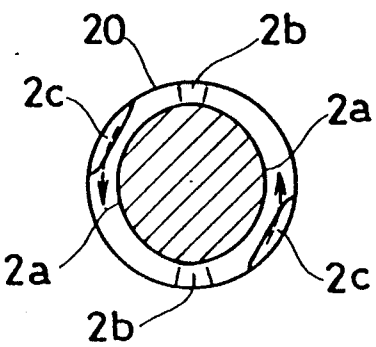
FIG. 2 is a section taken on line 1—1 of FIG. 1.
Figure 6:
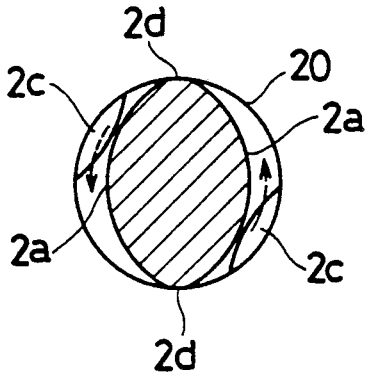
FIG. 6 is a section taken on line 5—5 of FIG. 1.

At the material introductive end (the righthand side in FIG. 1), as shown in FIG. 2, the communicating passages 2*b* are cut deep and broad to allow the material mixture to flow in substantially the same quantities as at the middle positions of the kneading recesses 2*a*. The communicating passages 2*b* become progressively shallower and narrower as they extend from the material introductive end toward an intermediate region. In the intermediate region, as shown in FIG. 4, the communicating passages 2*b* are shallow and narrow to allow the material mixture to flow in reduced quantities. At the terminal end (the left side in FIG. 1), as shown in FIG. 6, the communicating passages 2*b* are not cut and flow stoppers 2*d* are formed which have the height corresponding to the maximum outside diameter of the kneading section 2.

In addition, a communicating passage 2*c* is cut into a flight land 20 between a rear end, in the direction of material transport, of each kneading recess 2*a* and a forward end of a next kneading recess 2*a* to allow the material mixture to flow transversely of the helical direction.

Figure 3:
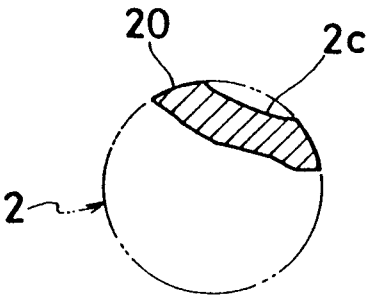
FIG. 3 is a partial section taken on line 2—2 of FIG. 1.
Figure 5:
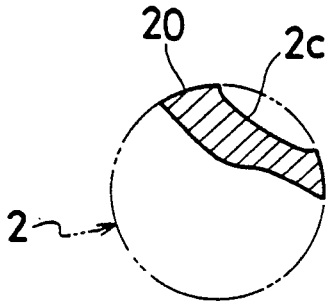
FIG. 5 is a partial section taken on line 4—4 of FIG. 1.
Figure 7:
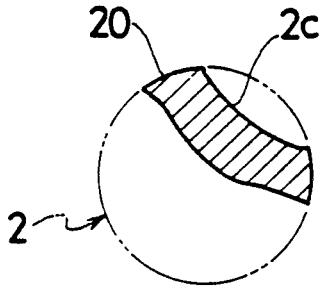
FIG. 7 is a partial section taken on line 6—6 of FIG. 1.

The communicating passages 2*c* are provided in the same helical direction as the kneading recesses 2*a* and in an appropriate number at a helical pitch twice that of the kneading recesses 2*a*. At the material introductive end, as shown in FIGS. 2 and 3, the communicating passages 2*c* are cut shallow and narrow to allow the material mixture to flow in small quantities. As shown in FIGS. 4 and 5, the communicating passages 2*c* become progressively deeper and broader from the material introductive end toward the terminal end. At the terminal end, as shown in FIGS. 6 and 7, the communicating passages 2c are formed deep and broad to allow the material mixture to flow in large quantities.

Figure 8:
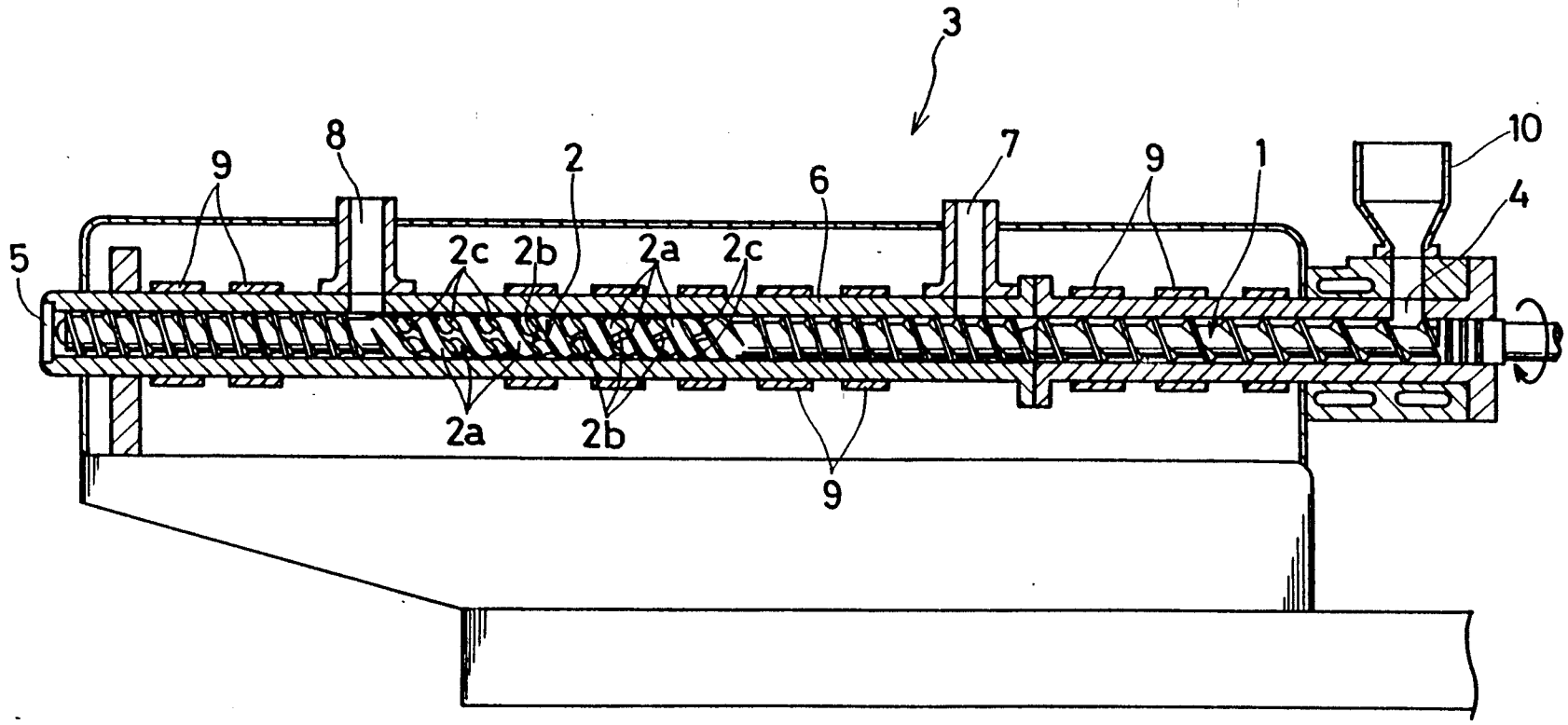
FIG. 8 is a view in vertical section of an extruder having the rotary kneading screw.

Referring to FIG. 8, an extruder 3 is shown as having the above rotary kneading screw 1. The rotary kneading screw 1 is rotatably supported inside a heating cylinder 6 defining a feed inlet 4 at a proximal end thereof (the righthand side in FIG. 8) for feeding materials, and an extrusion opening 5 at a distal end (the lefthand side in FIG. 8). The heating cylinder 6 further defines a gas exhaust vents 7 and 8 at upper surfaces of a proximal and a distal portions thereof. A plurality of band heaters 9 are arranged at intervals along the outer periphery of the cylinder 6 for heating and melting the materials. Further, a hopper 10 is mounted in communication with the feed inlet 4 for supplying the materials.

The rotary kneading screw 1 is connected to drive means such as a drive motor (not shown) to be driven for rotation in the material transport direction as indicated by an arrow.

The way in which the illustrated embodiment operates to knead the material mixture by means of the rotary kneading screw 1 will be described next.

Referring to FIG. 8, when the material mixture is supplied into the hopper 10 of the extruder 3, the material mixture is subjected to a transporting action of the rotary kneading screw 1 rotated in the material transport direction indicated by the arrow. In this state, the material mixture is successively transported in constant quantities from the hopper 10 into the heating cylinder 6 and toward the extrusion opening 5 at the lefthand side in FIG. 8.

During the transport, the material mixture is heated and melted by the band heaters 9 and degassed through the vent 7. Thereafter the material mixture flows into the kneading recesses 2a defined in the kneading section 2 to be kneaded positively.

More particularly, in the course of transport from the material introductive end to the intermediate region, the material mixture is successively divided to flow through the kneading recesses 2a arranged side by side in the helical direction (as shown in solid arrows in FIG. 1). The flow rates of the material mixture are reduced as the mixture moves through the communicating passages 2b formed progressively shallower and narrow. As a result, a progressively higher pressure is applied to the material mixture moving through the communicating passages 2b.

Part of the material mixture prevented from flowing by the communicating passages 2b is divided out successively to flow through the communicating passages 2c into next kneading recesses 2a transversely of the helical direction (as shown in dotted arrows in FIG. 1). The material mixture flows in increasing quantities through the communicating passages 2c formed progressively deeper and broader, whereby the material mixture is positively developed and divided transversely of the helical direction.

That is, the material mixture is divided to flow from the material introductive end to the intermediate region in progressively decreasing quantities through the communicating passages 2b and in progressively increasing quantities through the communicating passages 2c. Such flow control is provided by the relationship of material flow allowance between the communicating passages 2b formed progressively shallower and narrower and the communicating passages 2c formed progressively deeper and broader.

Next, in the course of transport from the intermediate region to the terminal end, the material mixture prevented from flowing by the communicating passages 2b formed progressively shallower is divided successively to flow through the communicating passages 2c into next kneading recesses 2a transversely of the helical direction (as shown in dotted arrows in FIG. 1).

Part of the material mixture is divided out to flow from each kneading recess 2a over the flight land 20 through a very small clearance between the flight land 20 and heating cylinder 6 into adjacent kneading recesses 2a in the helical direction and transversely of the helical direction.

Particularly in regions adjacent the terminal end, the material mixture flows in complex, compressed ways such that:

part of the mixture flows forward in the helical direction over the flow stopper 2d from one kneading recess 2a to a next kneading recess 2a, another part of the mixture flows forward transversely of the helical direction through the communicating passages 2c formed in the flight land 20 from one kneading recess 2a to a next kneading recess 2a, still another part of the mixture flows backward through the communicating passages 2c and through the small clearance between the flight land 20 and heating cylinder 6 from a kneading recess 2a lying adjacent the terminal end and having a high pressure to a kneading recess 2a lying adjacent the intermediate region and having a lower pressure, and the part of the mixture once having flowed backward flows forward as pushed by succeeding part of the material mixture.

Such flow modes in combination achieve uniform kneading of melted resin and mixed material.

As described above, from the material introductive end to the intermediate region of the kneading section 2, the material mixture is caused to flow in gradually decreasing quantities in the helical direction, and in gradually increasing quantities transversely of the helical direction. From the intermediate region to the terminal end of material transport in the kneading section 2, the flow of the material mixture in the helical direction is greatly limited to positively cause the material mixture to flow transversely of the helical direction. The material mixture is uniformed kneaded through pressure variations due to the flow limitations and variations due to the divided flows and by varying the quantities and direction in which the material mixture is transported.

Thereafter the material mixture is degassed through the vent 8 provided adjacent the distal end, and then successively extrusion-molded through the extrusion opening 5.

As described, the communicating passages 2c are cut in the flight lands 20 at a helical pitch twice that of the kneading recesses 2a. These communicating passages 2c may be cut in a single operation on an NC lathe or the like while rotating the rotary kneading screw 1. In this way, the communicating passages 2b may be cut with little error and high precision and in a greatly reduced operating time compared with a manual cutting operation, which provides the advantage of reducing the manufacturing cost of one rotary kneading screw 1.

Since the plurality of kneading recesses 2a are connected to one another through the communicating passages 2c, the material mixture prevented from flowing in the helical direction is successively divided to flow through these communicating passages 2c into next kneading recesses 2a transversely of the helical direction. This feature produces the effect of eliminating the possibility of unduly compressing the material mixture, thereby to prevent deterioration in the property and fluidity of the material mixture, and assuring an optimal kneaded state according to the type and characteristics of the material mixture.

The described embodiment, as shown in FIG. 1, includes no communicating passages 2b adjacent the terminal end of material transport so that the shaft of the screw 1 is level with the flight lands 20. However, this invention is not limited to this construction. The recesses may be formed shallow, as shown in FIG. 4, also adjacent the terminal end.

The sectional shape of the kneading recesses 2a is not limited to an ellipse around two points, but may be approximately triangular or rectangular. Further, the communicating passages 2c may be cut at a helical pitch three, four or more times that of the kneading recesses 2a.

What is claimed is:

1. A rotary kneading screw comprising a plurality of kneading recesses formed in peripheral surfaces of a kneading section at a fixed helical pitch along a helical direction, flight lands formed between adjacent pairs of said kneading recesses, and communicating passages formed in said flight lands at a helical pitch greater than the helical pitch of said kneading recesses, and cut between a rear end in the direction of material transport of each kneading recess and a forward end of a next kneading recess.

2. A rotary kneading screw comprising a plurality of kneading recesses formed in peripheral surfaces of a kneading section at a fixed helical pitch along a helical direction, flight lands formed between adjacent pairs of said kneading recesses, and communicating passages formed in said flight lands at a helical pitch greater than the helical pitch of said kneading recesses; and further comprising flow passages formed between adjacent pairs of said kneading recesses in the helical direction, said flow passages being formed progressively shallower and narrower from a material introductive end to a terminal end while said communicating passages formed on said flight lands arae formed progressively deeper and broader from the material introductive end to the terminal end.

* * * * *